United States Patent [19]

Suzuki et al.

[11] 4,398,570

[45] Aug. 16, 1983

[54] WEFT YARN DETECTOR

[75] Inventors: Hajime Suzuki, Anjo; Yoshimi Iwano, Ohbu; Akio Arakawa, Kariya, all of Japan

[73] Assignee: Kabushiki Kaisha Toyoda Jidoshokki Seisakusho, Kariya, Japan

[21] Appl. No.: 242,682

[22] Filed: Mar. 11, 1981

[30] Foreign Application Priority Data

Mar. 15, 1980 [JP] Japan ..... 55/34140

[51] Int. Cl.[3] ..... D03D 51/34

[52] U.S. Cl. ..... 139/370.2; 250/227

[58] Field of Search ..... 139/370.2, 370.1, 371, 139/336.1 R, 435; 250/559, 561, 571, 227; 356/237; 66/157, 163; 28/187; 57/81

[56] References Cited

U.S. PATENT DOCUMENTS

| | | | |
|---|---|---|---|
| 3,963,920 | 6/1976 | Palmer | 250/227 X |
| 4,085,777 | 4/1978 | Dadak et al. | 139/370.2 |
| 4,188,981 | 2/1980 | Suekane et al. | 139/370.2 |
| 4,254,613 | 3/1981 | Arita et al. | 57/81 |
| 4,295,499 | 10/1981 | Suzuki et al. | 139/370.2 |

FOREIGN PATENT DOCUMENTS

| | | | |
|---|---|---|---|
| 2105559 | 8/1972 | Fed. Rep. of Germany . | |
| 2355108 | 1/1978 | France | 139/370.2 |
| 2376423 | 7/1978 | France | 139/370.2 |

*Primary Examiner*—James Kee Chi

*Attorney, Agent, or Firm*—Wenderoth, Lind & Ponack

[57] ABSTRACT

A weft yarn detector for detecting weft yarn inserted into a weft yarn guide passage formed by a series of weft yarn guide members mounted on a slay of a loom is disclosed. The detector comprises a weft yarn detecting body with two supporting portions disposed opposite to each other on the opposite sides of the weft yarn guide passage, and weft yarn detecting elements supported by the two supporting portions. According to this invention, the detector is characterized by a flexible, thin, printed-wiring plate attached to the weft yarn detecting body and electrically connecting the weft yarn detecting elements to an external control system.

13 Claims, 5 Drawing Figures

WEFT YARN DETECTOR

BACKGROUND OF THE INVENTION

This invention relates to a loom and, more particularly, to a detector for detecting weft yarn inserted into the shed of the loom.

As is well known, air-jet looms are so constructed that a number of groups of weft yarn guide members each having an opening are arranged in alignment together on the slay so that the openings form a weft yarn guide passage, through which each weft yarn passes during one cycle of the weft insertion. In such a loom, one or more of the guide members has a weft yarn detector disposed therein to determine whether or not the weft yarn has passed through the weft yarn guide passage. For example, this type of weft yarn detector is shown in U.S. Pat. No. 4,188,981 and German Laid-Open specification No. 2,105,559.

Typically, each group consists of a predetermined number of weft yarn guide members fixedly mounted in a base to be formed into a single unit, and these separate units are then attached to the slay. Therefore, with respect to the particular guide member having the detector disposed therein as mentioned above, it must be installed into the associated base at the time the other guide members are installed, or after the other guide members have been installed. In the latter case, it is necessary to reserve a space in which the particular guide member is to be installed later on. This means that the detector is allowed to be arranged only in a preliminarily selected, fixed position.

However, as is well known in the art, a loom is required to produce woven cloth having a wide range of widths. Therefore, a detector in a fixed position may not effectively detect the weft yarn, depending upon the range of changes in the width of the cloth.

In order to remove this disadvantage of the position fixed detector, it has been provided to insert and mount a detector between adjacent guide members in a manner allowing the detector to move along the direction of the weft insertion. This provision enables the detector to be always positioned in an optimum detecting position even if the cloth width is changed by a large margin. Such a detector is disclosed in U.S. patent application Ser. No. 100,408 filed by H. Suzuki et al. and assigned to the same assignee as the present application.

At this point, it is to be noted that the spacing between the adjacent guide members is generally the same as, or smaller than, the effective thickness of the detector, because the detector has to be provided with photoelectric or magnetic detecting elements and wiring therefor. Thus, the detector has to be forcedly inserted between the adjacent guide members by spreading out them laterally, so that they are apt to be deformed, especially when they are made of plastic. This deformation will cause irregularities in the weft yarn guide passage, which may adversely effect the insertion of the weft yarn thereinto, resulting in failure of the insertion.

It is therefore a principal object of this invention to provide a weft yarn detector which can be formed so as to have a relatively small thickness and therefore mounted in position without adversely affecting weft yarn guide members on both sides thereof.

SUMMARY OF THE INVENTION

With this object in view, the present invention resides in a weft yarn detector for detecting a weft yarn inserted into a weft yarn guide passage formed by a series of weft yarn guide members mounted on a slay of a loom, the detector comprising a weft yarn detecting body with two supporting portions disposed opposite to each other on the opposite sides of the weft yarn guide passage, and weft yarn detecting elements supported by the two supporting portions, characterized by a flexible, thin, printed-wiring plate attached to the weft yarn detecting body and electrically connecting said weft yarn detecting elements to an external control system.

BRIEF DESCRIPTION OF THE DRAWINGS

This invention will become readily apparent from the following description of a preferred embodiment thereof, shown, by way of example only, in the accompanying drawings, in which.

DESCRIPTION OF THE PREFERRED EMBODIMENT

Figure 1:
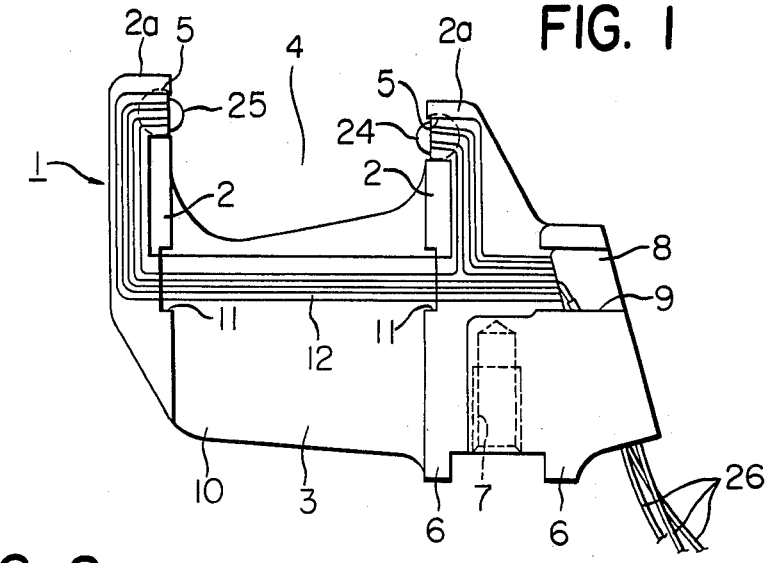
FIG. 1 is a front elevational view of a weft yarn detecting unit incorporating the present invention.
Figure 5:
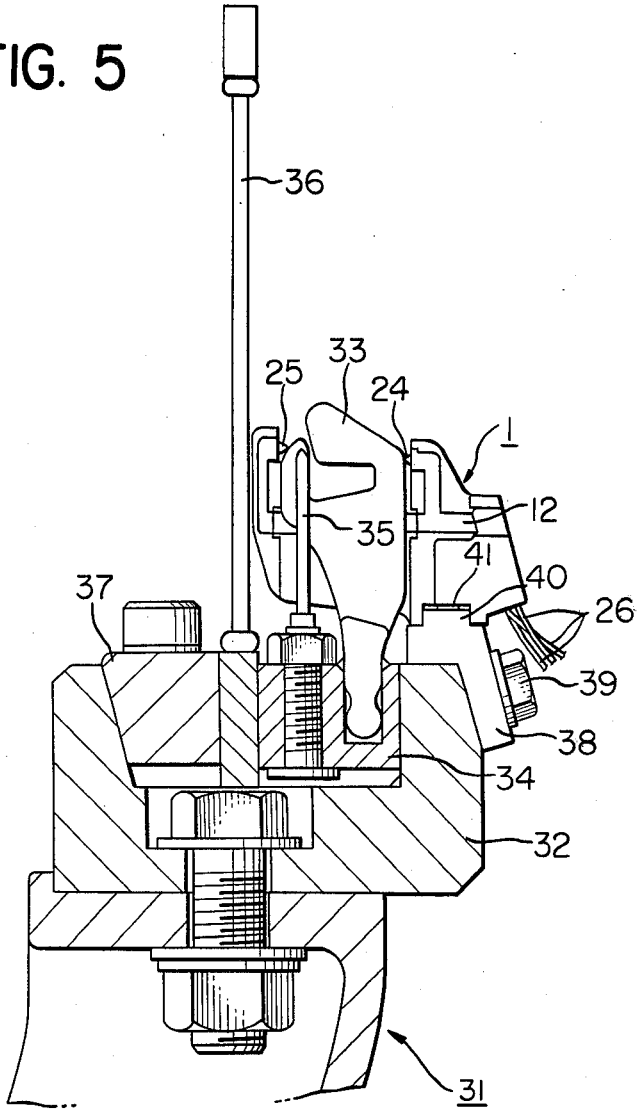
FIG. 5 is an elevational view showing, partly in section, the weft yarn detecting unit attached to the slay of a loom.

Referring to FIG. 1, there is shown a weft yarn detecting body 1 comprising a pair of supporting portions 2 arranged on the left and right sides of the body, and a connecting portion 3 connecting the supporting portions 2 together. These portions 2 and 3 define a C-shaped space 4 acting as a weft yarn guide opening, which is similar to an opening provided in a weft yarn guide member 33 (FIG. 5). Each supporting portion 2 terminates at an extension **2*a* having an accommodating recess 5 formed in its inner surface facing the weft yarn guide opening 4. As will be described hereafter, weft yarn detecting elements are securely accommodated in these recesses 5**.

Figure 3:
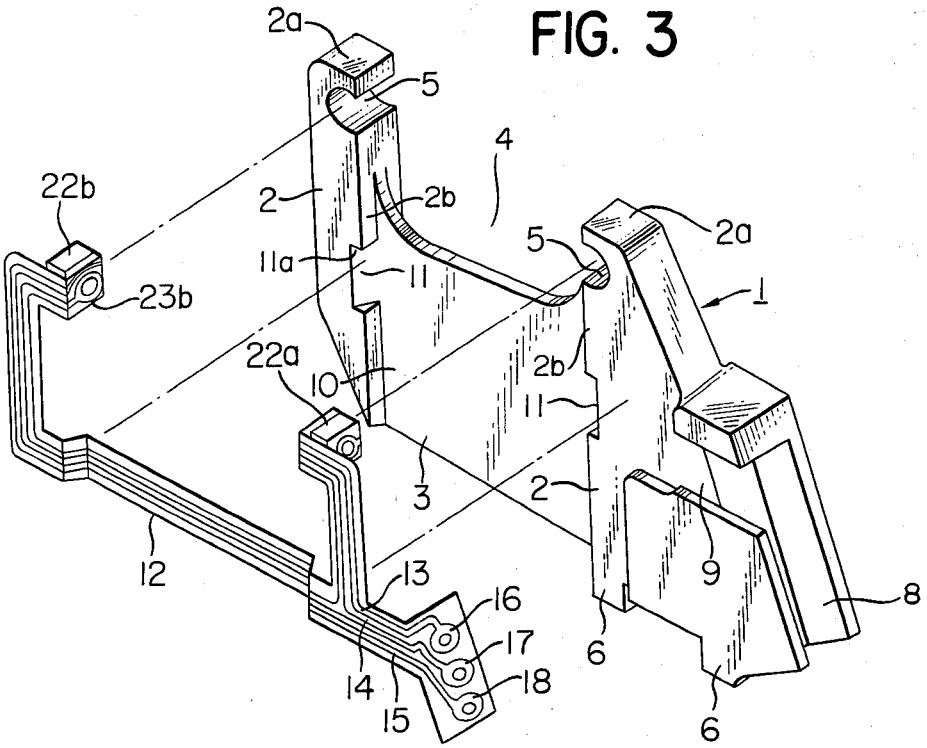
FIG. 3 is a perspective view for explaining the manner in which the flexible printed-wiring plate is attached to the weft yarn detecting body.

The connecting portion 3 is provided on its bottom surface with a pair of leg parts or portions 6, between which a threaded hole 7 is provided as shown by the dotted line in FIG. 1. As best shown in FIG. 3, a recess 8 having a channel section is provided in the outer surface of the right supporting portion 2 to receive therein wires 26 (FIG. 1). A notch or slot 9 is also provided in the front surface of the right supporting portion 2 so as to communicate with the channel-shaped recess 8.

As shown in FIG. 3, in each of the front and back surfaces of the connecting portion 3 there is a wide concavity 10 substantially corresponding in width to the weft yarn guide member 33 (FIG. 5). Since the concavities 10 are provided in the connecting portion 3, the thickness of the latter can be decreased to smaller than the spacing between the adjacent weft yarn guide members 33. At the same height as the slot 9, a pair of notches 11 each having triangular cross-section are provided in the inner edges **2*b* of the front surfaces of the paired supporting portions 2 so that an inclined wall 11*a* of each notch 11 extends from the connecting portion 3; that is, the notch 11 is coextensive with the concavity 10**.

Figure 2:
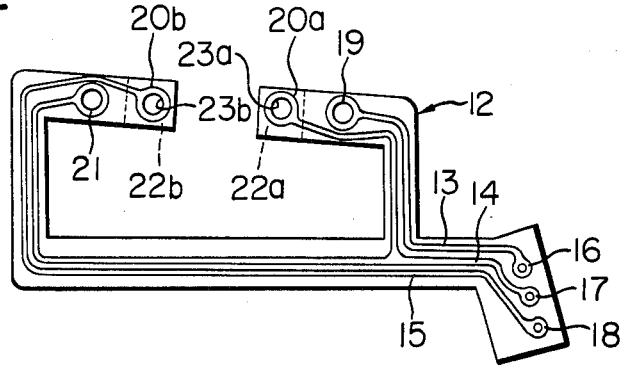
FIG. 2 is a front elevational view of a flexible printed-wiring plate made in accordance with this invention.

On the front surface of the weft yarn guide body 1, there is a flexible, very thin, printed-wiring plate 12, which is bifurcated so as to be capable of being stuck on the front surfaces of the supporting portions 2. As best shown in FIG. 2, the plate 12 comprises a printed circuit including three conductive layers 13, 14 and 15 formed on the plate in the conventional manner. The layers 13 and 15 extend respectively between contacts 16 and 18 formed on one end of the plate and contacts 19 and 20*b* formed on the bifurcated ends, and the layer 14 is connected at one end to a contact 17 formed on the one end of the plate and at the other branched ends to contacts 20*a* and 21 formed on the bifurcated ends of the plate.

Figure 4:
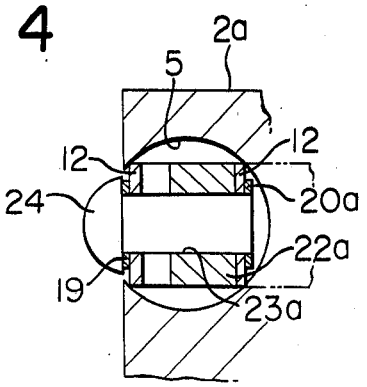
FIG. 4 is a sectional view of essential parts of the weft yarn detecting unit.

Rigid blocks 22*a* and 22*b* having a rectangular cross-section are connected to the bifurcated ends of the plate 12 carrying the contacts 20*a* and 20*b*. In the rigid blocks 22*a* and 22*b*, through openings 23*a* and 23*b* are centrally provided extending between the opposite surfaces of the blocks 22*a* and 22*b* as shown in FIGS. 3 and 4. In each of the contacts 20*a* and 20*b*, an opening is centrally provided, and the through openings 23*a* and 23*b* open into these openings provided in the contacts 20*a* and 20*b*, respectively.

The flexible printed-wiring plate 12 thus formed is bent as shown in FIG. 3 at its said one end and bifurcated ends. Said one end of the plate 12 is entered through the slot 9 into the channel 8 and stuck to the bottom of the channel 8. On the other hand, the bifurcated ends as well as the rigid blocks 22*a* and 22*b* are fitted into the accommodating recesses 5 respectively.

A light emitting element 24 is inserted into the through opening 23*a* of the rigid block 22*a* disposed in the right accommodating recess 5 so that, as shown in FIG. 4, its one terminal is connected to the contact 20*a* and its other terminal to the contact 19. Also, a light receiving element 25 such as a photo-transistor is inserted into the opening 23*b* of the rigid block 22*b* disposed in the left accommodating recess 5, with its terminals being connected to the contacts 20*b* and 21 in the same way as mentioned with respect to the light emitting element. The light receiving element 25 is arranged opposite the light emitting element 24 and therefore can receive a light beam emitted from the light emitting element 24. The light receiving element can detect the inserted weft yarn when it moves across the light beam, as is well known in the art.

The contacts 16 to 18 are connected to the wires 26 (FIG. 2) in the conventional manner and then, to an external control system, which is not shown because it may be of a conventional construction.

In FIG. 5, the detecting body 1 and printed plate 12 thus formed into a single unit are mounted on a mechanism 31 for pivotally moving the weft yarn guide members 33 and others in the manner well known in the art. The mechanism 31 includes a slay 32, by which the guide members 33 received in mounting members 34 are securely supported in a manner allowing the guide members 33 to be spaced from each other along the direction of the weft insertion. A predetermined number of sub-nozzles 35, each discharging a jet of fluid into the weft yarn guide passage formed by the guide members 33 to assist a not shown main nozzle in inserting the weft yarn into the weft yarn guide passage, are screw thread fitted to the mounting member 34 at predetermined intervals along the direction of the weft insertion. The mounting member 34 also serves to attach a reed 36 to the slay 32 in cooperation with a clamping member 37 having wedge-shaped cross-section.

To detachably and adjustably connect the weft yarn detecting unit to the slay 32, a bed 38, of which an upper portion provides a seat 40 for the detecting unit, is mounted with a bolt 39 on the right side of the slay 32 opposite to the reed 36. The detecting unit lies on the seat 40 with its leg parts 6 positioned on the opposite sides of the seat 40 so that the detecting unit and the bed 38 can be connected together with a bolt 41, which is engaged in the threaded hole 7 shown in FIG. 1.

As described above, the thickness of the connecting portion 3 of the detecting body 1 is made smaller than the spacing between the adjacent guide members 33 by providing, on the opposite sides of the connecting portion 3, the wide concavities 10 fitting onto the adjacent guide members 33, while the light emitting and receiving elements 24 and 25 accommodated in the left and right recesses 5 of the detecting body 1 are connected through the very thin, flexible printed-wiring plate 12 to the wires 26 in the channel-shaped recess 8 remote from the weft yarn guide members 33. This allows the detecting unit to be inserted into a spacing between any adjacent guide members 33 without spreading them out laterally. Thus, there occurs no deformation of the guide members 33 with the insertion of the detecting unit therebetween.

Although a single preferred embodiment has been described above, this invention is of course not limited thereto. For example, the mounting position of the printed-wiring plate 12 may be altered to a suitable position such as on the upper surface of the connecting portion 3, that is, the bottom wall of the C-shaped weft yarn guide space 4. Furthermore, the printed-wiring plate 12 may be fitted into a groove provided in the side surface of the detecting body 1 so that the whole printed-wiring plate 12 is embedded in the detecting body 1. Alternatively, the printed-wiring plate 12 may be fully contained in the detecting body by dividing the detecting body into two halves and connecting the two halves together after inserting the printed-wiring plate therebetween. In these cases, the printed-wiring plate can be prevented from being damaged due to contact with the adjacent weft yarn guide member.

Although in the specific embodiment of this invention the detecting unit has been described as inserted between adjacent weft yarn guide members, it may be disposed in lieu of a guide member so that it also acts as a weft yarn guide. In this case, the weft yarn guide can also be provided with a groove or divided into two haves as described above so as to dispose the printed-wiring plate in the groove or between the two halves. If the printed-wiring plate is disposed in the weft yarn guide as described above, this weft yarn guide will not cause any damage to the warp yarn because the printed-wiring plate does not contact the warp yarn, even when the weft yarn detecting unit is arranged within the range of the cloth width. Also, in this case, since the printed-wiring plate having a very small thickness does not increase the thickness of the weft yarn guide, the weft yarn guide has sufficient strength to prevent it from being vibrated into and out of the weft yarn passage by the vibration of the loom. Thus, failure of the weft insertion can be prevented.

What we claim is:

1. A weft yarn detector for detecting weft yarn inserted into a weft yarn passage formed by a series of weft yarn guide members mounted on a slay of a loom, said detector comprising:

a weft yarn detecting body adapted to be mounted directly on a slay of a loom, said body including two supporting portions to be disposed opposite to each other on opposite sides of a weft yarn guide passage in the mounted position of said body;

weft yarn detecting elements mounted on said two supporting portions; and a flexible, thin printed wiring plate mounted on said body and including means electrically connected to said detecting elements for electrically connecting said detecting elements to an external control system.

2. A detector as claimed in claim 1, wherein said plate includes one end having electrical contacts to be connected to the external control system and two bifurcated ends having electrical contacts electrically connected to respective said detecting elements, said supporting portions have formed therein respective recesses, each said bifurcated end of said plate fits within a respective said recess, one said supporting portion has formed therein a further recess, and said one end of said plate fits within said further recess.

3. A detector as claimed in claim 2, wherein each said bifurcated end is connected to a respective rigid block which fits within a respective said recess.

4. A detector as claimed in claim 1, wherein said body further includes a connecting portion joining said two supporting portions, said connecting portion having a thickness smaller than a spacing between any two adjacent weft yarn guide members and adapted to be positioned therein.

5. A detector as claimed in claim 1, wherein said detecting elements comprise a light emitting element on one said supporting portion and a light receiving element on the other said supporting portion.

6. A detector as claimed in claim 1, wherein said body further includes a pair of leg portions extending from one of said supporting portions, and a threaded hole extending into said body at a location between said leg portions.

7. In a loom assembly of the type including a slay, a series of weft yarn guide members mounted on said slay and defining a weft yarn passage into which is to be inserted a weft yarn, and a detector for detecting a weft yarn inserted into said passage, the improvement wherein said detector comprises:

a weft yarn detecting body mounted directly on said slay without connection to said guide members, said body including two supporting portions disposed opposite to each other on opposite sides of said passage;

weft yarn detecting elements mounted on said two supporting portions; and a flexible, thin printed wiring plate mounted on said body and including means electrically connected to said detecting elements for electrically connecting said detecting elements to an external control system.

8. The improvement claimed in claim 7, wherein said plate includes one end having electrical contacts to be connected to the external control system and two bifurcated ends having electrical contacts electrically connected to respective said detecting elements, said supporting portions have formed therein respective recesses, each said bifurcated end of said plate fits within a respective said recess, one said supporting portion has formed therein a further recess, and said one end of said plate fits within said further recess.

9. The improvement claimed in claim 8, wherein each said bifurcated end is connected to a respective rigid block which fits within a respective said recess.

10. The improvement claimed in claim 7, wherein said body further includes a connecting portion joining said two supporting portions, said connecting portion having a thickness smaller than a spacing between any two adjacent said weft yarn guide members, and said connecting portion is positioned within a said spacing between two adjacent said guide members without deformation thereof.

11. The improvement claimed in claim 7, wherein said detecting elements comprise a light emitting element on one said supporting portion and a light receiving element on the other said supporting portion.

12. The improvement claimed in claim 7, wherein said body further includes a pair of leg portions extending from one of said supporting portions, and a threaded hole extending into said body at a location between said leg portions.

13. The improvement claimed in claim 12, wherein said slay includes means having extending therefrom a seat, said leg portions being positioned on opposite sides of said seat, and further comprising a bolt extending through said means and threaded into said threaded hole, thereby fixing said body directly on said slay.

* * * * *